US010230179B2

(12) United States Patent
Wilinski

(10) Patent No.: US 10,230,179 B2
(45) Date of Patent: Mar. 12, 2019

(54) ELECTRICAL CONNECTION TERMINAL WITH A TWO-PART OPERATING ELEMENT

(71) Applicant: Phoenix Contact GmbH & Co. KG, Blomberg (DE)

(72) Inventor: Bernd Wilinski, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/544,889

(22) PCT Filed: Jan. 20, 2016

(86) PCT No.: PCT/EP2016/051061
§ 371 (c)(1),
(2) Date: Jul. 20, 2017

(87) PCT Pub. No.: WO2016/116476
PCT Pub. Date: Jul. 28, 2016

(65) Prior Publication Data

US 2018/0006385 A1 Jan. 4, 2018

(30) Foreign Application Priority Data

Jan. 21, 2015 (DE) ..... 10 2015 100 823

(51) Int. Cl.
*H01R 4/48* (2006.01)
*H01R 9/22* (2006.01)
(Continued)

(52) U.S. Cl.
CPC ..... *H01R 4/4836* (2013.01); *H01R 9/223* (2013.01); *H01R 9/2416* (2013.01); *H01R 4/4827* (2013.01); *H01R 9/26* (2013.01)

(58) Field of Classification Search
CPC .. H01R 4/4836; H01R 4/4845; H01R 4/5008; H01R 4/4827; H01R 4/4818; H01R 4/489
See application file for complete search history.

(56) References Cited

U.S. PATENT DOCUMENTS 3,816,819 A * 6/1974 Judd ..... H01R 4/2412 439/409
4,647,131 A * 3/1987 Van Woensel ..... H01R 12/79 439/260
(Continued)

FOREIGN PATENT DOCUMENTS

DE 69703829 T2 7/2001
DE 102008039868 A1 3/2010
(Continued)

*Primary Examiner* — Ross N Gushi
(74) *Attorney, Agent, or Firm* — Leydig, Voit & Mayer, Ltd.

(57) ABSTRACT

An electrical connection terminal includes: a connection terminal housing having a conductor insertion opening; a busbar arranged in the connection terminal housing; a spring element rotatably mounted in the connection terminal housing and pivotable into an open position and into a closed position, a conductor inserted into the conductor insertion opening being clampable against the busbar by the spring element in the closed position; and an actuation element rotatably mounted in the connection terminal housing and by which the spring element can be actuated for transfer into the open position and into the closed position. The actuation element includes a base body, which has a tool insertion opening, and an actuation arm. The base body and the actuation arm are formed in two parts, the actuation arm being formed pivotally movable relative to the base body.

10 Claims, 4 Drawing Sheets

(51) Int. Cl.
*H01R 9/24* (2006.01)
*H01R 9/26* (2006.01)

(56) References Cited

U.S. PATENT DOCUMENTS 4,729,738 A * 3/1988 Heng ..... H01R 4/2433 439/395
4,759,726 A * 7/1988 Naylor ..... H01R 4/5008 439/441
5,810,628 A * 9/1998 Trudel ..... H01H 71/08 439/864
6,120,315 A * 9/2000 Gaertner ..... H01R 4/2433 439/395
6,238,233 B1 * 5/2001 Drexler ..... H01R 4/2412 439/409
6,341,989 B1 * 1/2002 Jaag ..... H01R 4/4827 439/725
6,689,955 B2 * 2/2004 Doutaz ..... H01R 4/4836 174/135
7,048,571 B2 * 5/2006 Wilinski ..... H01R 4/2433 439/409
7,104,833 B2 * 9/2006 Oesterhaus ..... H01R 4/4836 439/441
7,244,140 B2 * 7/2007 Edenharter ..... H01R 4/4818 439/439
7,344,404 B2 * 3/2008 Wilinski ..... H01R 4/2433 439/409
7,354,319 B2 * 4/2008 Camino ..... H01R 4/4872 439/441
7,896,685 B2 * 3/2011 Eppe ..... H01H 1/5844 439/441
7,963,812 B2 * 6/2011 Ilkhanov ..... H01R 4/5008 439/107
8,062,077 B2 * 11/2011 Hayashi ..... H01R 9/2408 439/725
8,113,858 B1 * 2/2012 Chiang ..... H01R 13/701 439/188
8,129,641 B2 * 3/2012 Majewski ..... H01R 4/4845 200/335
8,210,865 B2 * 7/2012 Hayashi ..... H01R 4/4836 439/409
8,241,072 B2 * 8/2012 Hayashi ..... H01R 9/2408 439/725
8,262,422 B1 * 9/2012 Chiang ..... H01R 4/4836 439/441
8,444,443 B2 * 5/2013 Schafmeister ..... H01R 4/4836 439/441
8,475,191 B2 * 7/2013 Schafmeister ..... H01R 4/4836 439/266
8,480,424 B2 * 7/2013 Koellmann ..... H01R 4/4845 439/358
8,500,498 B2 * 8/2013 Abundis ..... H01R 4/4836 439/828
8,794,994 B2 * 8/2014 Kollmann ..... H01R 4/4836 439/441
8,979,573 B1 * 3/2015 Barber ..... H01R 4/4836 439/441
9,083,115 B2 * 7/2015 Hoppmann ..... H01R 4/4827
9,124,034 B2 * 9/2015 Kollmann ..... H01R 4/4836
9,160,085 B2 * 10/2015 Jun ..... H01R 4/4827
9,184,540 B2 * 11/2015 Wilinski ..... H01R 13/629
9,219,332 B2 * 12/2015 Wendt ..... H01R 13/629
9,240,650 B2 * 1/2016 Wu ..... H01R 4/48
9,276,331 B2 * 3/2016 Stadler ..... H01R 4/4836
9,343,828 B2 * 5/2016 Bishop ..... H01R 4/4818
9,397,444 B1 * 7/2016 Wu ..... H01R 4/4845
9,413,082 B2 * 8/2016 Gassauer ..... H01R 4/4836
9,413,085 B2 * 8/2016 Hoppmann ..... H01R 4/4854
9,425,519 B2 * 8/2016 Wendt ..... H01R 4/5008
9,437,940 B1 * 9/2016 Rao ..... H01R 4/4836
9,466,894 B2 * 10/2016 Wu ..... H01R 4/4836
9,466,895 B2 * 10/2016 Kollmann ..... H01R 4/4836
9,466,897 B1 * 10/2016 Wu ..... H01R 9/2491
9,525,216 B2 * 12/2016 Wu ..... H01R 4/4809
9,525,217 B2 * 12/2016 Kollmann ..... H01R 4/4836
9,525,219 B2 * 12/2016 Kollmann ..... H01R 4/4836
9,537,228 B2 * 1/2017 Wendt ..... H01R 4/5008
9,543,666 B2 * 1/2017 Wendt ..... H01R 4/5008
9,543,668 B2 * 1/2017 Wendt ..... H01R 4/5008
9,543,700 B2 * 1/2017 Kollmann ..... H01R 4/4836
9,559,440 B2 * 1/2017 Wendt ..... H01R 4/4836
9,601,843 B2 * 3/2017 Jarmuth ..... H01R 4/4836
9,680,237 B2 * 6/2017 Aporius ..... H01R 4/4836
9,761,961 B2 * 9/2017 Wendt ..... H01R 4/4827
9,774,107 B2 * 9/2017 Kamo ..... H01R 9/2416
9,793,652 B2 * 10/2017 Bausch ..... H01R 4/4827
9,806,462 B2 * 10/2017 Wendt ..... H01R 13/639
9,825,402 B2 * 11/2017 Kollmann ..... H01R 4/4836
2002/0037670 A1 * 3/2002 Wilmes ..... H01R 4/2433 439/709
2003/0008569 A1 * 1/2003 Matsumoto ..... H01R 4/4827 439/835
2003/0066673 A1 * 4/2003 Doutaz ..... H01R 4/4836 174/652
2004/0077210 A1 * 4/2004 Kollmann ..... H01R 4/4818 439/441
2006/0128206 A1 * 6/2006 Oesterhaus ..... H01R 4/4836 439/441
2007/0072481 A1 * 3/2007 Edenharter ..... H01R 4/4818 439/441
2007/0141910 A1 * 6/2007 Camino ..... H01R 4/4872 439/607.41
2008/0248699 A1 * 10/2008 Schafer ..... H01R 4/4818 439/729
2010/0081316 A1 * 4/2010 Eppe ..... H01H 1/5844 439/441
2011/0151699 A1 * 6/2011 Schafmeister ..... H01R 4/4836 439/266
2011/0207372 A1 * 8/2011 Breen, IV ..... H01R 4/4836 439/629
2011/0209972 A1 * 9/2011 Eppe ..... H01H 71/08 200/293
2011/0223795 A1 * 9/2011 Schafmeister ..... H01R 4/4836 439/370
2011/0244708 A1 * 10/2011 Hayashi ..... H01R 4/4836 439/370
2011/0318972 A1 * 12/2011 Koellmann ..... H01R 4/4836 439/729
2012/0077391 A1 * 3/2012 He ..... H01R 4/4818 439/816
2012/0238156 A1 * 9/2012 Hayashi ..... H01R 4/4836 439/820
2013/0095688 A1 * 4/2013 Koellmann ..... H01R 4/4845 439/358
2013/0157520 A1 * 6/2013 Koellmann ..... H01R 4/4836 439/834
2014/0065892 A1 * 3/2014 Jun ..... H01R 4/4827 439/787
2014/0127932 A1 * 5/2014 Hoppmann ..... H01R 4/4827 439/370
2014/0134892 A1 * 5/2014 Wendt ..... H01R 4/5008 439/709
2014/0322957 A1 * 10/2014 Wendt ..... H01R 4/489 439/370
2014/0370740 A1 * 12/2014 Kollmann ..... H01R 4/4836 439/438
2015/0044897 A1 * 2/2015 Wu ..... H01R 4/48 439/352
2015/0162671 A1 6/2015 Hoppmann et al.
2015/0357727 A1 * 12/2015 Gassauer ..... H01R 4/4836 439/751
2015/0372401 A1 * 12/2015 Stolze ..... H01R 4/4836 439/816
2015/0372402 A1 * 12/2015 Kollmann ..... H01R 4/4818 439/816
2015/0380837 A1 * 12/2015 Kollmann ..... H01R 4/4836 439/721
2015/0380838 A1 * 12/2015 Kollmann ..... H01R 4/4836 439/625

(56) References Cited

U.S. PATENT DOCUMENTS

| | | | | |
|---|---|---|---|---|
| 2016/0049737 | A1* | 2/2016 | Aporius | H01R 4/4836<br>439/733.1 |
| 2016/0056548 | A1* | 2/2016 | Wendt | H01R 4/5008<br>439/725 |
| 2016/0149319 | A1* | 5/2016 | Wendt | H01R 4/5008<br>439/863 |
| 2016/0211592 | A1* | 7/2016 | Wendt | H01R 4/4827 |
| 2016/0218447 | A1* | 7/2016 | Beckmann | H01R 4/4818 |
| 2017/0047680 | A1* | 2/2017 | Kollmann | H01R 4/4836 |
| 2017/0331201 | A1* | 11/2017 | Wu | H01R 4/4818 |
| 2018/0006385 | A1* | 1/2018 | Wilinski | H01R 4/4836 |

FOREIGN PATENT DOCUMENTS

| | | | |
|---|---|---|---|
| DE | 102012011794 | A1 | 12/2013 |
| WO | WO 2014170388 | A1 | 10/2014 |

* cited by examiner

ELECTRICAL CONNECTION TERMINAL WITH A TWO-PART OPERATING ELEMENT

CROSS-REFERENCE TO PRIOR APPLICATIONS

This application is a U.S. National Phase application under 35 U.S.C. § 371 of International Application No. PCT/EP2016/051061, filed on Jan. 20, 2016, and claims benefit to German Patent Application No. DE 10 2015 100 823.8, filed on Jan. 21, 2015. The International Application was published in German on Jul. 28, 2016 as WO 2016/116476 A1 under PCT Article 21(2).

FIELD

The invention relates to an electrical connection terminal that comprises a connection terminal housing having a conductor insertion opening, a busbar arranged in the connection terminal housing, a spring element rotatably mounted in the connection terminal housing and pivotable into an open position and into a closed position, a conductor inserted into the conductor insertion opening being clampable against the busbar by means of the spring element in the closed position.

BACKGROUND

A connection terminal of this type is known for example from DE 10 2012 011 794 A1. In this case, the actuation element is mounted rotatably in the connection terminal housing via a bearing element. The actuation element comprises a base body and an actuation arm that is formed integrally on the base body and that has a smaller thickness than the base body. The actuation arm is formed curved in the direction of the spring element and serves to a release a holding portion of the spring element from the latching thereof when the spring element is to be transferred from the closed position into the open position, in that the holding portion is curved in the direction of the actuation limb by means of the actuation arm. Once the holding portion is released from the latching, the spring element can pivot upwards in the direction of the actuation element in that the spring element pivots, together with the holding portion and at least part of the actuation limb, into a free space formed on the actuation element, without triggering a rotational movement of the actuation element. So as to transfer the spring element back from the open position into the closed position, the actuation element is rotated in such a way that the base body thereof presses against the actuation limb of the spring element so as to press said limb downwards. The rotational movement of the actuation element may take place by means of a tool, in particular a screwdriver, in that said screwdriver is inserted into a tool insertion opening formed on the actuation element, the tool insertion opening being formed on the base body of the actuation element.

A drawback of this actuation element is the relatively large required space of the actuation element due to the relatively large pivot angle thereof, the pivot angle of the actuation element being determined by the relatively large pivot angle of the actuation arm formed integrally on the base body. So as to make a pivot movement of the actuation element possible, an additional free space, into which the actuation element, in particular the elongate actuation arm thereof, can dip during the pivoting of the actuation element, has to be provided in the connection terminal housing. As a result of the additional free space, it is necessary to form the entire connection terminal wider.

SUMMARY

In an embodiment, the present invention provides electrical connection terminal, comprising: a connection terminal housing having a conductor insertion opening; a busbar arranged in the connection terminal housing; a spring element rotatably mounted in the connection terminal housing and pivotable into an open position and into a closed position, a conductor inserted into the conductor insertion opening being clampable against the busbar by the spring element in the closed position; and an actuation element rotatably mounted in the connection terminal housing and by which the spring element is configured to be actuated for transfer into the open position and into the closed position, the actuation element comprising a base body, which has a tool insertion opening, and an actuation arm. The base body and the actuation arm are respective parts, the actuation arm being pivotably movable relative to the base body.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
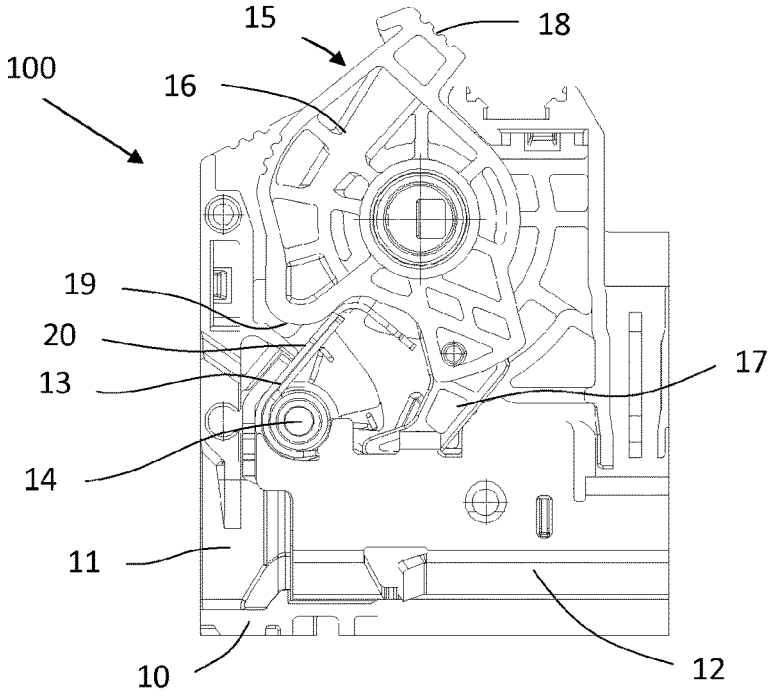
FIG. 1 is a schematic drawing of an electrical connection terminal according to the invention without a housing cover, the spring element being in an open position.

The invention is distinguished in that the base body and the actuation arm are formed in two parts, the actuation arm being formed pivotably movable relative to the base body.

It is further provided that the actuation element is no longer formed in a single piece, and instead, as a result of the two-part formation of the actuation element, the base body and the actuation arm of the actuation element are two separately formed components that are combined within the connection terminal in such a way that a relative movement between the actuation arm and the base body is made possible. Because the actuation arm is now formed or arranged pivotably movable on the base body, during a rotational movement of the actuation element it is no longer necessary for the actuation arm to join in with the entire pivot movement of the base body, and instead it becomes possible for the actuation arm now only to follow the pivoting movement of the base body over a partial distance of this pivoting movement. As a result, the required pivot angle of the actuation arm to actuate the spring element, in particular to release the latching of the spring element and to transfer the spring element from the closed position into the open position, can be reduced. As a result, it can be provided that the pivot angle of the actuation arm is less than the pivot angle of the base body. Thus, it is also no longer necessary for an additional free space to be provided in the connection terminal housing for the actuation element and in particular the actuation arm so as to be able to ensure a sufficient rotational movement or pivot movement of the actuation element. As a result of the additional free space no longer being required within the connection terminal housing, the installation width of the connection terminal as a whole can be reduced whilst the functionality of the connection terminal remains unchanged, making it possible to reduce the overall required installation space for the connection terminal. As regards the width of the connection terminal, the required space for the actuation element within the connection terminal is therefore now only determined by the size or dimensions of the base body of the actuation element, and is independent of the size or dimensions of the actuation arm. In addition, by comparison with the solutions known thus far, a symmetrical arrangement of the actuation arm with respect to the spring element is made possible, meaning that when the spring element is actuated the actuation arm can apply a force to the spring element, in particular to the downwardly curved holding portion of the spring element, central to the width of the spring element. As a result, when the spring element is actuated, it is loaded uniformly, in particular in the region of the holding portion, so as to be able to release the spring element or the holding portion of the spring element from the undercuts on the busbar. Tilting or twisting of the spring element or of the holding portion of the spring element during actuation can thus be prevented by means of the actuation arm.

The actuation arm is preferably mounted pivotably movable in a recess formed in the base body. The actuation arm can thus be received within the base body, in such a way that a defined pivot movement of the actuation arm is made possible. The recess is preferably formed in such a way that at least part of the actuation arm is enclosed in a U shape by the base body, in such a way that lateral tilting of the actuation arm during a pivoting movement can be reliably prevented. The actuation arm is thus preferably enclosed by a wall of the recess and thus of the base body both at the two end faces thereof and at the longitudinal faces thereof, in such a way that the recess forms a slit-like opening in the base body. The actuation arm is preferably not received within the recess over the entire length of said arm, but merely over a sub-region of the length thereof. The other sub-region of the actuation arm protrudes from the base body, in such a way that the actuation of the spring element by means of the actuation arm can be made possible by means of this sub-region. The recess can also be formed open in such a way that the wall of the recess only covers the two end faces of the actuation arm, and the longitudinal faces of the actuation arm are exposed and not covered by a wall of the recess or of the base body, in such a way that these longitudinal faces of the actuation arm themselves form an outer face of the actuation element.

In particular if the recess is formed open and not as a slit-shaped opening, it may preferably be provided that a web is formed in the recess, the actuation arm being able to enclose the web in a U shape. As a result of the web and the U-shaped enclosure of the actuation arm of the web, the actuation arm can be held more securely within the open recess of the base body, since a tilting movement of the actuation arm can be prevented by the web. In this embodiment, the actuation arm preferably comprises a recess in which the web can engage and by means of which the actuation arm can enclose the web in a U shape. The actuation arm can thus be slid onto the web within the recess of the base body.

So as to be able to limit the pivot movement of the actuation arm within the base body and thus be able to exert a compressive force on the spring element from the actuation arm, it is preferably provided that at least one stop is formed on the base body. If the actuation arm is positioned on this stop, the actuation arm is pivoted together with the base body, meaning that in particular the spring element can be actuated and in particular a force can be exerted on the spring element from the actuation arm. The stop is preferably formed within the recess in the base body. For example, the stop may be formed by a wall of the recess or else an additional rib may also be formed in the recess. Preferably, a second stop is formed that is arranged opposite the first stop, in such a way that the actuation arm can be pivoted between the two stops. As a result, the pivoting movement of the actuation arm can take place between two defined positions and the pivot angle of the actuation arm can be limited to a defined maximum size. For example, a first stop may be formed as a pressing edge and a second stop may be formed as a holding edge.

It may further be provided that a locking unit for locking the actuation arm in a position relative to the base body is arranged on the base body and/or on the actuation arm. By means of the locking unit, a pivoting movement of the actuation arm relative to the base body can be prevented, since the locking unit can make it possible to fix the actuation arm to the base body. Fixing of this type may for example be of use for mounting purposes or else during particular switching situations, for example during actuation of the spring element by means of the actuation arm. The locking unit may for example be formed as latch means, for example in that openings may be provided on the base body and latch pins may be formed on the actuation arm, the latch pins being able to engage in the recesses of the openings so as to fix the actuation arm in a defined position on the base body. Alternatively, it is also possible for example for the openings to be formed on the actuation arm and the latch pins to be formed on the base body. Instead of openings and latch pins, other embodiments of latch means or locking unit are also possible.

So as to be able to facilitate mounting the actuation element, it is preferably provided that the base body and the actuation arm are mounted pivotably movable on a bearing element formed on the connection terminal housing. The bearing element may for example be formed as a bearing pin, on which both the base body and the actuation arm are arranged. For this purpose, the base body may comprise an opening which preferably extends into the recess of the base body to receive the actuation arm. The actuation arm may preferably comprise a bearing eye by means of which the actuation arm can be slid onto the bearing element. Thus, during assembly, the actuation arm can initially be inserted into the base body, in particular into the recess of the base body, in such a way that the bearing eye is arranged flush with the opening on the base body, so as subsequently to be able to assemble the base body together with the actuation arm on the bearing element, in that the actuation element is slid onto the bearing element using the opening of the base body and the bearing eye of the actuation arm. By way of a shared bearing position of the base body and the actuation arm on the connection terminal housing, or via the bearing element, the required installation space for the actuation element and thus for the entire connection terminal can be further reduced.

Further, it is preferably provided that the connection terminal housing comprises two conductor insertion openings, and two spring elements and two actuation elements are arranged in the housing, the two actuation elements being rotatable counter to one another and being opposite one another in such a way that the actuation arms of the actuation elements are arranged in succession in the division direction. As a result of this special arrangement, in the case of a plurality of actuation elements in a housing of a connection terminal the required installation space can be subdivided as compactly as possible if two conductor connections are provided, making it possible for the entire electrical contact terminal to be formed particularly compact.

FIG. 1 is a detailed drawing of an electrical connection terminal 100. The electrical connection terminal 100 comprises a conductor insertion opening 11 that is formed in a connection terminal housing 10 and via which a conductor can be inserted into the connection terminal 100 so as to be able to clamp or connect the conductor within the connection terminal 100 in an electrically conductive manner.

To clamp or connect the inserted conductor in an electrically conductive manner, a busbar 12 is arranged within the connection terminal housing 10, and is formed U-shaped in the embodiment shown here.

Further, a spring element 13 is arranged rotatably mounted in the connection terminal housing 10 by positioning the spring element 13 on a swivel pin 14. As a result of the rotatable mounting of the spring element 13, it can be pivoted into an open position and a closed position, it being possible in the closed position for a conductor inserted into the conductor insertion opening 11 to be clamped against the busbar 11 by means of the spring element 13. A closed position of the spring element 13 is shown for example in FIG. 2. By contrast, FIG. 1 shows the spring element 13 in an open position.

Further, an actuation element 15, by means of which the spring element 13 can be actuated for transfer into the open and into the closed position, is rotatably mounted in the connection terminal housing 100. The actuation element 15 has a base body 16 and an actuation arm 17. The actuation arm 17 and the base body 16 are formed as two separate components, in such a way that the actuation element 15 is formed in two parts. As a result of the two-part formation of the actuation element 15, it is possible for the actuation arm 17 to be formed pivotably movable relative to the base body 16. A tool insertion opening 18, into which a tool, for example a screwdriver, can be inserted so as to actuate, in particular rotate or pivot, the actuation element 15, is formed on the base body 16. By means of the actuation arm 17, the spring element 13 is actuated so as to transfer said element from the closed position into the open position.

Figure 2:
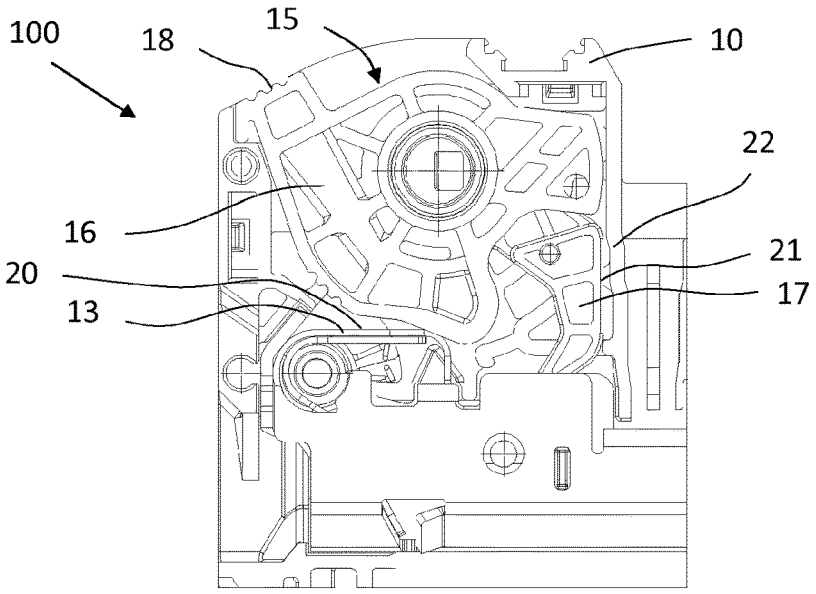
FIG. 2 is a further schematic drawing of the electrical connection terminal according to the invention without a housing cover, the spring element being in a closed position.

FIG. 2 shows the spring element 13 in the closed position. To transfer the spring element 13 from the open position shown in FIG. 1 into the closed position shown in FIG. 2, there is counterclockwise rotational movement of the actuation element 15. During this counterclockwise rotational movement, an edge 19 formed on the outer circumference of the base body 16 presses on the spring element 13, in particular on an upper face 20 of the spring element 13, in such a way that the spring element 13 is pressed downwards in the direction of the busbar 12 by means of the edge 19, so as to press a conductor inserted into the connection terminal 100 against the busbar 12. During the counterclockwise rotational movement of the actuation element 15, the base body 16 is twisted counterclockwise, and the actuation arm 17 is also rotated counterclockwise together with the base body 16 at least over a partial distance of the rotational movement of said body. The rotational movement or pivot movement of the actuation arm 17 thus take place not over the entire pivot angle of the base body 16, but rather only over a sub-region, in such a way that, in addition to the complete pivot movement of the actuation element 15, a pivot movement within the actuation element 15 is carried out in that the actuation arm 17 is pivoted relative to the base body 16 so that the actuation arm 17 in an end position, as is shown in FIG. 2, by contrast with the position shown in FIG. 1 is pivoted downwards relative to the base body 16. In this pivoted end position, a longitudinal edge 21 of the actuation arm 17 is arranged parallel to a vertically formed wall 22 of the connection terminal housing 10. If no pivoting movement of the actuation arm 17 relative to the base body 16 were possible, for example if the actuation arm 17 were formed in a single piece with the base body 16, in the end position shown in FIG. 2 the longitudinal edge 21 of the actuation arm 17 would not be arranged parallel to the wall 22 of the connection terminal housing 10, but would instead be positioned substantially perpendicular to the wall 22, in such a way that the wall 22, so as not to obstruct the pivoting movement of the actuation element 15, would have to be formed shifted to the right away from the actuation element 15, meaning that the entire connection terminal housing 10 would have to be formed wider and would thus require more installation space.

Figure 3:
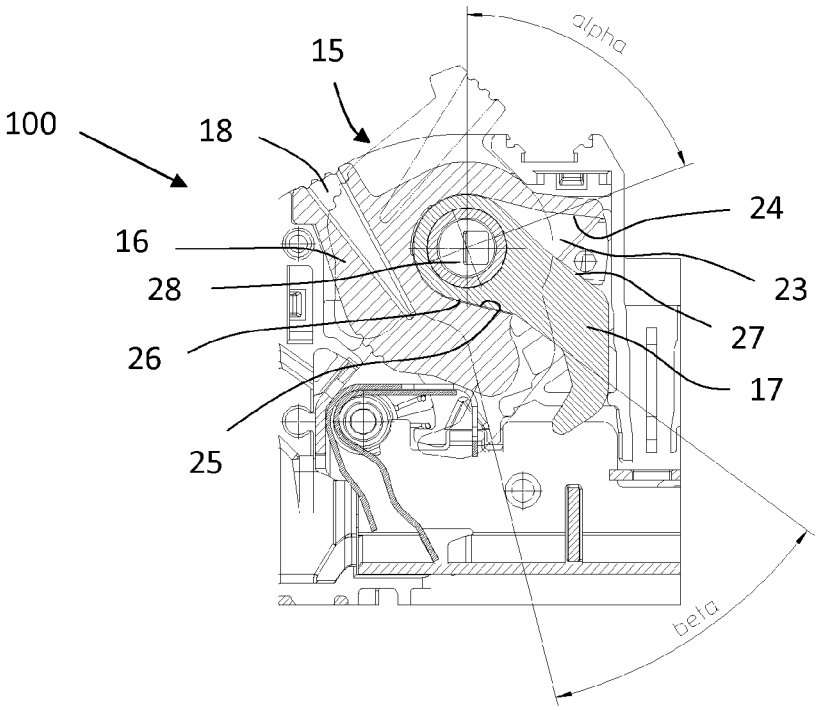
FIG. 3 is a schematic sectional drawing of the electrical connection terminal according to the invention, the spring element being in a closed position.

FIG. 3 is a sectional drawing of the connection terminal 100 shown in FIG. 2, the actuation element 15 being in the end position shown in FIG. 2. In FIG. 3, the pivot angle alpha of the base body 16 and the pivot angle beta of the actuation arm 17 are shown for a rotational movement of the actuation element 15 from the open position of the spring element 13 into the closed position of the spring element 13, it being discernable in this context that the pivot angle beta of the actuation arm 17 is less than the pivot angle alpha of the base body 16.

Further, in the sectional drawing shown in FIG. 3 of the actuation element 15, it can be seen that the tool insertion opening 18, formed as an acute angle, is formed in the base body 16.

Further, a recess 23, within which the actuation arm 17 is mounted pivotably movable, is formed in the base body 16. The recess 23 comprises a first stop 24 and a second stop 25 for limiting the pivoting movement of the actuation arm 17, the two stops 24, 25 being formed by a wall of the recess 23. In the end position of the actuation element 15 shown in FIG. 3, when the spring element 13 is in the closed position, the actuation arm 17 is positioned with a first end face 26 flat on the lower, second stop 25, the stop 25 in this case being formed as a holding edge. The upper, first stop 24 forms a pressing edge, a second end face 27 of the actuation arm 17, opposite the first end face 26, being positioned on this stop 24 formed as a pressing edge during actuation of the spring element 13 as shown in FIG. 4, so as to be able to exert a force or compressive force on the spring element 13 to open the spring element 13.

In FIG. 3, it can further be seen that the base body 16 and the actuation arm 17 are together mounted pivotably movable on a bearing element 28 formed on the connection terminal housing 10. This bearing element 28 is in this case formed as a bearing pin, on which both the base body 16 and the actuation arm 17 are slid on and mounted. For this purpose, the base body 16 comprises an opening 29 in the region of the recess 23, as can be seen for example in FIGS. 5 and 6, and the actuation arm 17 comprises a bearing eye 30, the bearing eye 30 of the actuation arm 17 being arranged flush with the opening 29 so as to be able to mount the actuation element 15 and in particular the base body 16 and the actuation arm 17 on the bearing element 28 together and thus simultaneously.

Figure 4:
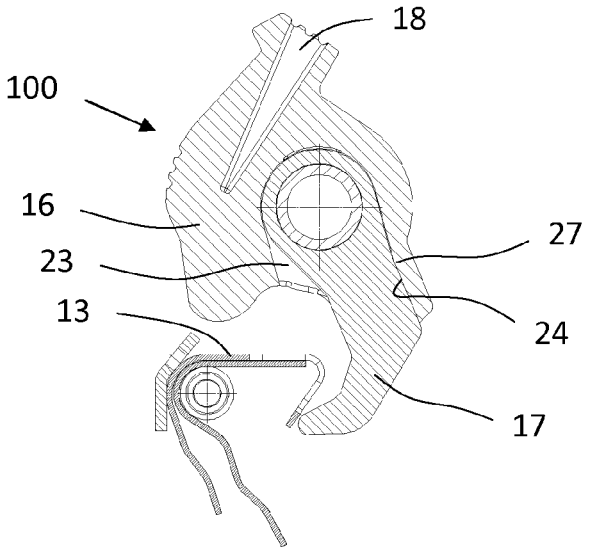
FIG. 4 is a schematic sectional drawing of the actuation element and the spring element of the electrical connection terminal shown in FIG. 1-3 during actuation of the spring element by means of the actuation arm of the actuation element.

FIG. 4 is a sectional drawing of the actuation element 15 during actuation of the spring element 13 to transfer the spring element 13 from the closed position shown here into an open position as shown in FIG. 1. For this purpose, the actuation element 15 is rotated clockwise, in such a way that the actuation arm 17 of the actuation element 15 comes into contact with the spring element 13. In this context, both the base body 16 and the actuation arm 17 are rotated clockwise, but the rotational movement or pivoting movement of the actuation arm 17 only starts once the base body 16 has been rotated through a particular pivot angle, far enough that the upper, first stop 24 of the base body 16 strikes the upper, second side face 27 of the actuation arm 17, as shown in FIG. 4, so as to pivot the actuation arm 17 in the direction of the spring element 13 together with the base body 16 during a further twist movement of the actuation element 15. Once the end face 27 of the actuation arm 17 is positioned on the upper, first stop 24, formed as a pressing edge, during further rotational movement of the actuation element 15 or of the base body 16 a force, in particular a compressive force, can be exerted on the actuation arm 17 from the base body 16 and on the spring element 13 from the actuation arm 17, so as to transfer the spring element 13 from the closed position into an open position as shown in FIG. 1.

Figure 5:
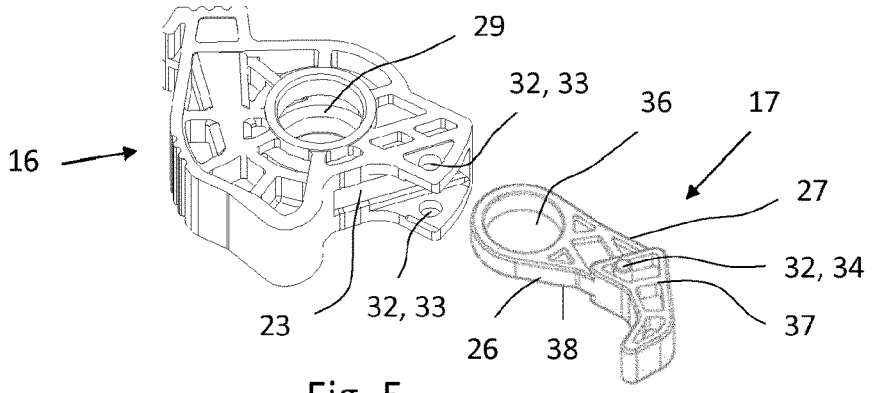
FIG. 5 is a schematic drawing of a base body and an actuation arm of an actuation element in accordance with an embodiment of the invention.
Figure 6:
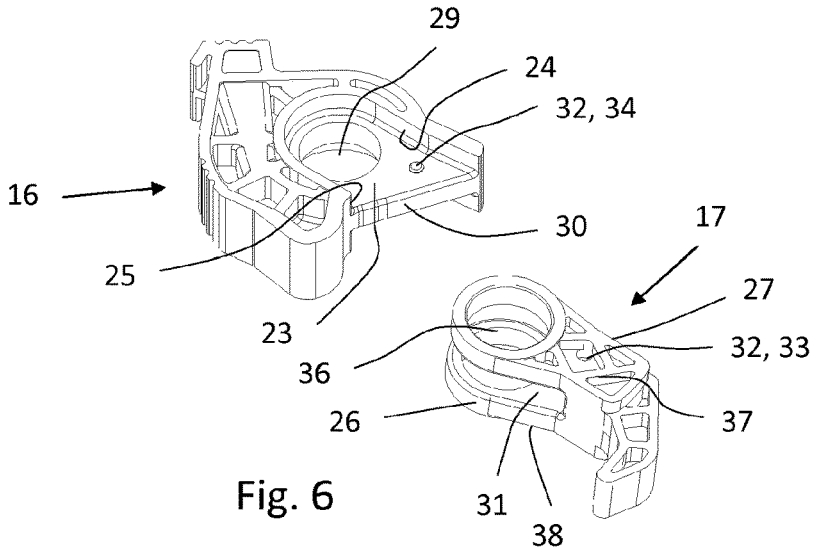
FIG. 6 is a schematic drawing of a base body and an actuation arm of an actuation element in accordance with a further embodiment of the invention.

FIG. 5 shows a base body 16 and an actuation arm 17 of an actuation element 15 in accordance with a possible embodiment. FIG. 6 shows the base body 16 and the actuation arm 17 of an actuation element 15 in a further possible embodiment.

In the embodiment shown in FIG. 5, the recess 23 is formed as a slit-shaped opening in the base body 16, in such a way that when the actuation arm 17 is in a mounted state on the base body 16 at least part of the actuation arm 17, in particular the part comprising the bearing eye 36, is enclosed in a U shape by the base body 16, as can also be seen in FIGS. 1 and 2. The actuation arm 17 is thus enclosed both at the two end faces 26, 27 thereof and at the two longitudinal faces 37, 38 thereof by a wall of the recess 23.

By contrast with the embodiment shown in FIG. 5, in the embodiment shown in FIG. 6 a web 30 is formed in the recess 23 of the base body 16 and extends between the first stop 24 and the second stop 25. The actuation arm 17 comprises a recess 31 by means of which the actuation arm 17 can be inserted into the recess 23 in such a way that the actuation arm 17 encloses the web 30 in a U shape. In the embodiment shown in FIG. 6, by contrast with the embodiment shown in FIG. 5, the recess 23 is formed open, in such a way that the wall of the recess 23 merely covers the two end faces 26, 27 of the actuation arm 17, and the longitudinal faces 37, 38 of the actuation arm 17 are exposed and not covered by a wall of the recess 23 or of the base body 16.

As can further be seen in FIG. 5 and FIG. 6, locking unit 32 are formed on the base body 16 and the actuation arm 17, the locking unit 32 on the base body 16 being formed as openings 33 and the locking unit 32 on the actuation arm 17 being formed as latch pins 34, the latch pins 34 being able to engage in or hook into the openings 33 to fix the actuation arm 17 in a particular position relative to the base body 16. In the embodiment shown in FIG. 6, the locking unit 32 are formed in a reversed arrangement, in that the locking unit 32 in the form of a latch pin 34 is formed on the base body 16 and the locking unit 32 in the form of an opening 33 is formed on the base body 16. The locking unit 32 are preferably positioned in such a way that the actuation arm 17 can be fixed on the base body 16 by means of the locking unit 32, rigidly in the position on the base body 16 in which the second end face 27 of the actuation arm 17 is positioned on the first stop 24 formed as a pressing edge and a force is exerted on the spring element 13 from the actuation arm 17 so as to open the spring element 13.

Figure 7:
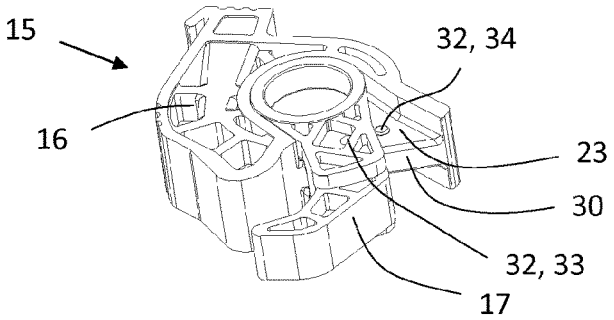
FIG. 7 is a schematic drawing of the actuation element shown in FIG. 6 in an assembled state.

FIG. 7 shows the embodiment shown in FIG. 6 of the actuation element 15 when the actuation arm 17 is mounted on the base body 16.

Figure 8:
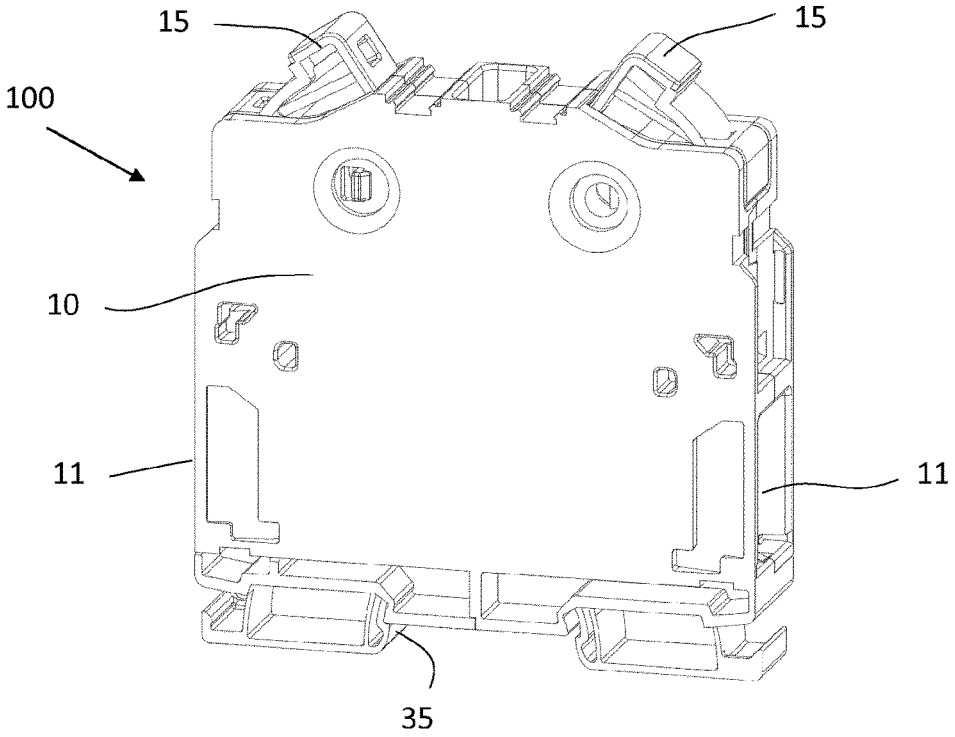
FIG. 8 is a schematic drawing of an electrical connection terminal according to the invention having two conductor insertion openings and two actuation elements.

FIG. 8 shows an embodiment of a connection terminal 100 in which two conductor insertion openings 11 are formed in the connection terminal housing 10, and two spring elements 10 are arranged opposite one another and in addition two actuation elements 15 are arranged opposite one another in the connection terminal housing 10. The connection terminal housing 10 comprises on the lower face thereof a latch foot 35 by means of which the connection terminal housing 10 or the connection terminal 100 can be latched to a support rail. The two actuation elements 15 arranged in the connection terminal housing 10 are formed rotatable counter to one another, and are positioned opposite one another in such a way that the actuation arms 17 of the actuation elements 15 are arranged in succession in the division direction.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Connection terminal 100
Connection terminal housing 10
Conductor insertion opening 11
Busbar 12
Spring element 13
Swivel pin 14
Actuation element 15
Base body 16
Actuation arm 17
Tool insertion opening 18
Edge 19
Upper face 20
Longitudinal edge 21
Wall 22
Recess 23
First stop 24
Second stop 25
First end face 26
Second end face 27
Bearing element 28
Opening 29
Web 30
Recess 31
Locking unit 32
Opening 33
Latch pin 34
Latch foot 35
Bearing eye 36
Longitudinal face 37
Longitudinal face 38

The invention claimed is:

1. An electrical connection terminal, comprising:

a connection terminal housing having a conductor insertion opening;

a busbar arranged in the connection terminal housing;

a spring element rotatably mounted in the connection terminal housing and pivotable into an open position and into a closed position, a conductor inserted into the conductor insertion opening being clampable against the busbar by the spring element in the closed position; and an actuation element rotatably mounted in the connection terminal housing and by which the spring element is configured to be actuated for transfer into the open position and into the closed position, the actuation element comprising a base body, which has a tool insertion opening, and an actuation arm, the actuation arm being rotatably mounted in the connection terminal housing, wherein the base body and the actuation arm are respective parts, the actuation arm being pivotably movable relative to the base body.

2. The electrical connection terminal according to claim 1, wherein the actuation arm is mounted pivotably movable in a recess of the base body.

3. The electrical connection terminal according to claim 2, wherein a web is disposed in the recess, the actuation arm enclosing the web in a U shape.

4. The electrical connection terminal according to claim 1, wherein at least one stop configured to limit the pivoting movement of the actuation arm is disposed on the base body.

5. The electrical connection terminal according to claim 1, wherein a locking unit configured to lock the actuation arm in a position relative to the base body is disposed on the base body and/or on the actuation arm.

6. The electrical connection terminal according to claim 1, wherein the base body and the actuation arm are mounted pivotably movable on a bearing element disposed on the connection terminal housing.

7. The electrical connection terminal according to claim 1 wherein the connection terminal housing comprises two conductor insertion openings, and two spring elements and two actuation elements are disposed in the connection terminal housing, the two actuation elements being rotatable counter to one another, and being positioned opposite one another such that the actuation arms of the actuation elements are arranged in succession in a division direction.

8. An electrical connection terminal, comprising:

a connection terminal housing having a conductor insertion opening;

a busbar arranged in the connection terminal housing;

a spring element rotatably mounted in the connection terminal housing and pivotable into an open position and into a closed position, a conductor inserted into the conductor insertion opening being clampable against the busbar by the spring element in the closed position; and an actuation element rotatably mounted in the connection terminal housing and by which the spring element is configured to be actuated for transfer into the open position and into the closed position, the actuation element comprising a base body, which has a tool insertion opening, and an actuation arm, wherein the base body and the actuation arm are respective parts, the actuation arm being pivotably movable relative to the base body, wherein the actuation arm is mounted pivotably movable in a recess of the base body, and wherein a web is disposed in the recess, the actuation arm enclosing the web in a U shape.

9. An electrical connection terminal, comprising:

a connection terminal housing having a conductor insertion opening;

a busbar arranged in the connection terminal housing;

a spring element rotatably mounted in the connection terminal housing and pivotable into an open position and into a closed position, a conductor inserted into the conductor insertion opening being clampable against the busbar by the spring element in the closed position; and an actuation element rotatably mounted in the connection terminal housing and by which the spring element is configured to be actuated for transfer into the open position and into the closed position, the actuation element comprising a base body, which has a tool insertion opening, and an actuation arm, wherein the base body and the actuation arm are respective parts, the actuation arm being pivotably movable relative to the base body, and wherein a locking unit configured to lock the actuation arm in a position relative to the base body is disposed on the base body and/or on the actuation arm.

10. An electrical connection terminal, comprising:

a connection terminal housing having a conductor insertion opening;

a busbar arranged in the connection terminal housing;

a spring element rotatably mounted in the connection terminal housing and pivotable into an open position and into a closed position, a conductor inserted into the conductor insertion opening being clampable against the busbar by the spring element in the closed position; and an actuation element rotatably mounted in the connection terminal housing and by which the spring element is configured to be actuated for transfer into the open position and into the closed position, the actuation element comprising a base body, which has a tool insertion opening, and an actuation arm, wherein the base body and the actuation arm are respective parts, the actuation arm being pivotably movable relative to the base body, and wherein the base body and the actuation arm are mounted pivotably movable on a bearing element disposed on the connection terminal housing.

* * * * *